US006791706B1

(12) United States Patent
Panunto et al.

(10) Patent No.: US 6,791,706 B1
(45) Date of Patent: Sep. 14, 2004

(54) MACHINE AND PROCESS FOR MAKING AND APPLYING DOCUMENTS TO OBJECTS

(75) Inventors: John P Panunto, Mississauga (CA); Wing Fai Lam, Mississauga (CA)

(73) Assignee: PSI Peripheral Solutions Inc., Mississauga (CA)

( * ) Notice: Subject to any disclaimer, the term of this patent is extended or adjusted under 35 U.S.C. 154(b) by 870 days.

(21) Appl. No.: 09/688,125

(22) Filed: Oct. 16, 2000

(51) Int. Cl.[7] ..... G06F 15/00
(52) U.S. Cl. ..... 358/1.15; 358/1.18; 358/1.12
(58) Field of Search ..... 358/1.1, 1.5, 1.12, 358/1.15, 1.18, 401; 382/100, 101, 137; 283/49, 81; 53/390, 396, 438, 458

(56) References Cited

U.S. PATENT DOCUMENTS

| | | | | | |
|---|---|---|---|---|---|
| 5,376,048 | A | * | 12/1994 | Whiteside | 462/6 |
| 5,465,554 | A | * | 11/1995 | Lewis et al. | 53/438 |
| 5,593,749 | A | * | 1/1997 | Instance | 428/40.1 |
| 5,618,064 | A | * | 4/1997 | Main | 283/80 |
| 5,751,287 | A | * | 5/1998 | Hahn et al. | 345/775 |
| 6,019,540 | A | * | 2/2000 | Senior | 283/81 |
| 6,301,379 | B1 | * | 10/2001 | Thompson et al. | 382/137 |
| 6,364,364 | B1 | * | 4/2002 | Murphy | 283/79 |
| 6,467,241 | B1 | * | 10/2002 | Odenthal et al. | 53/458 |
| 6,666,378 | B2 | * | 12/2003 | Davila et al. | 235/487 |

* cited by examiner

*Primary Examiner*—Gabriel Garcia

(57) ABSTRACT

An adjustable high-speed machine and process that makes and applies related documents to items comprising of a document receiving station which accepts various sized output from printers, an accumulator station which uses various types of sensors, optical marks and/or software to control the number of documents accumulated which form a set and initiates movement to other stations. The machine and process also consist of a document folder which provides various industry standard folds to sets of documents followed by an optional fold to create a smaller size and a transport device which presents sets of documents to other devices in different orientations and directions. Another device manages single or multiple rolls of adhesive or non-adhesive materials and creates a container or pouch for documents or devices, a device cuts, slices or separates material from rolls of tape or other material at programmed lengths to complete the pouch or container creation process. Also included is a device to dispense documents, or pouches containing documents or items into a box, envelope or container and a device to apply self-adhesive output directly to a box, envelope, container or item. The final other device and software are used to control various internal and external interfaces and other stations including printers, accumulators, folders, enclosers, separators, delivery, application devices, conveyors or computers for the creation, process and application of related documents to items.

2 Claims, 4 Drawing Sheets

Block Diagram

Figure 1 Perspective View
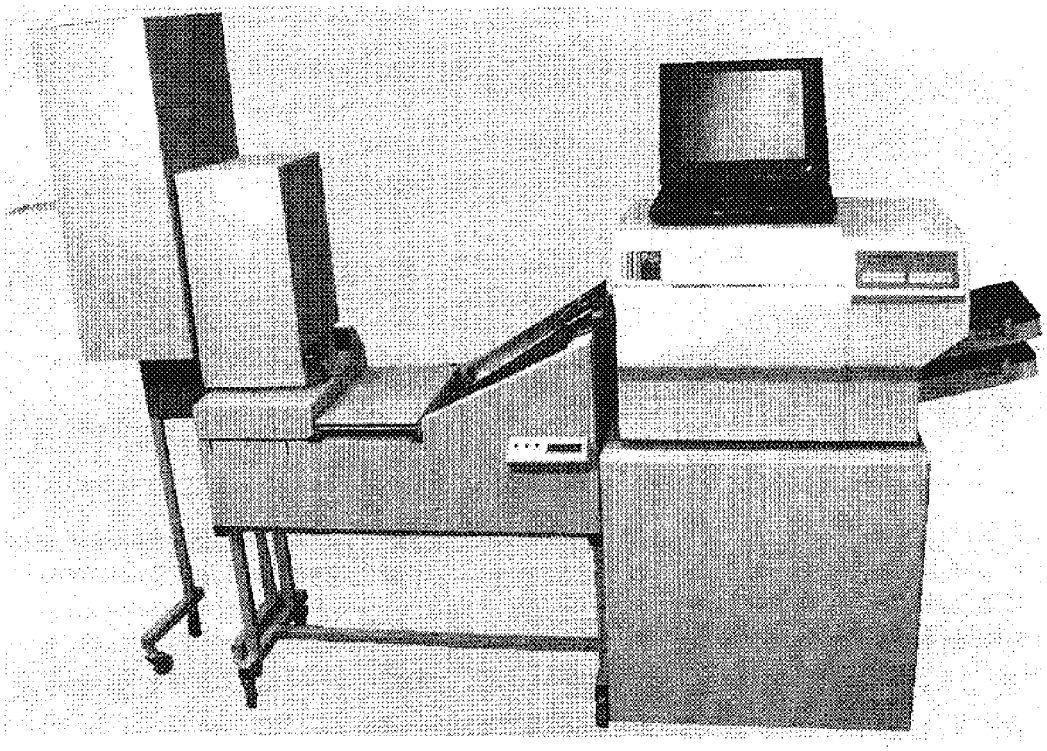

Figure 2 Block Diagram
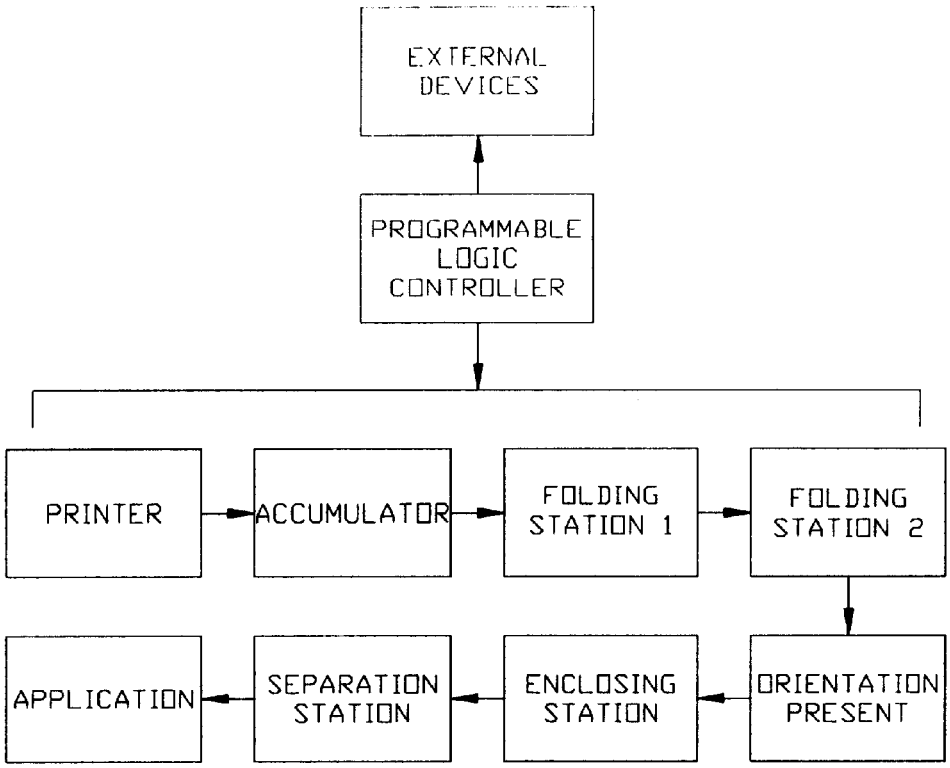

Figure 3 Dual Fold & Orient
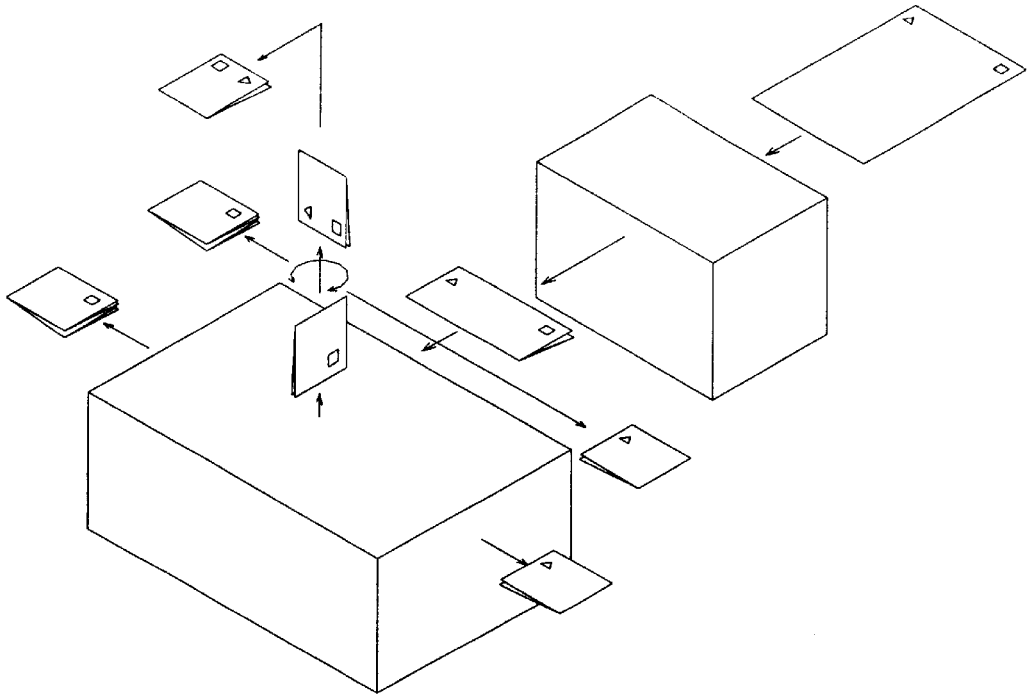

Figure 4 Enclosure Application
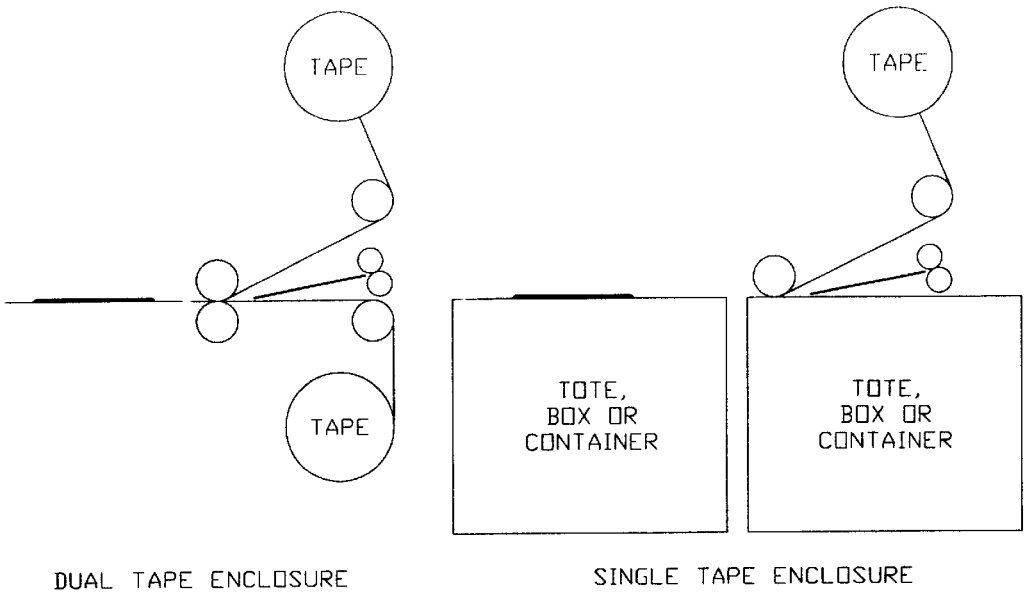

MACHINE AND PROCESS FOR MAKING AND APPLYING DOCUMENTS TO OBJECTS

BACKGROUND OF THE INVENTION

This invention relates generally to the field of order fulfillment, distribution and inventory control, more particularly to a machine, and process for making and applying related documents or control items such as packing slips to goods. The objective is to reduce the time and cost related to current execution of this process.

Distribution warehouses, organizations or carriers who fulfill orders for goods or items generally rely on significant and manually intensive processes, or at best partially automated processes, to create and affix a packing slip to a shipment of goods or items. First, the document or set of documents must be created describing the content, warranty, control marks, operation, drawings, destination address or any other pertinent information or inventory control object or transponder related to the shipment or item. These related documents are generally folded from letter size to an industry standard size of one sixth the original size (4.25" by 3.75") and display the intended destination but maintain content privacy through the use of paper folds. The documents are then manually inserted into a translucent adhesive pouch to accommodate shipments of any size, including small packages or envelopes. The adhesive protection is then removed and the pouch is affixed to the shipment and carried to its destination through common forwarding methods. Using a combination of paper-handling devices in a specific sequence, controlled and driven by invented software and other electronics with various sensors, this manually intensive process can be partially or completely automated with the use of this invention.

During the month of May, 2000 the named inventors conceptualized and developed this invention in Mississauga, Ontario, Canada. The invention is comprised of various software, paper-handling and application devices. Portions of this invention have been developed over the past ten years at PSI Peripheral Solutions Inc. for various custom solutions as provided to clients in Canada and the United States.

Through the unique use of single or double rolls of tape, the invention creates a functional container for single or multiple, folded documents and/or inventory control transponders. Through the use of specific materials, selected adhesive portions, transparency and markings, the pouch created by the tape may then be used to suit various needs and automation requirements for fulfillment and/or inventory control.

Earlier technology and patents for devices such as printers, folders, inserters and tape handlers, separate various stages of application or document handling. No other single invention to control the complete fulfillment process exists other than this invention.

Since no other machine exists, the invention now offers the ability to partially or completely automate the process of creating and attaching required shipment documents. This invention nearly eliminates the high-cost of manual intervention by using this new process. Since no other technology exists, this invention can now accommodate various printer types, document sizes, number of documents forming a related set and folded to industry standard sizes. This invention manufactures various styles and types of pouches for various needs or uses. This machine and process also selectively separate and/or apply fulfillment documents, thereby nearly eliminating the cost of labour.

SUMMARY OF THE INVENTION

The primary objective of the invention is to provide a machine that makes and applies related documents to shipments or items, thus reducing fulfillment costs.

Another objective of the invention is to provide a machine that accepts documents of various orientations and sizes from common printers to lower fulfillment automation costs. The invention is also a machine which assembles one or more related documents or control items into a set to reduce fulfillment costs. A further objective of this invention is to provide a machine which folds sets of related documents to a smaller size thus increasing uses and reducing fulfillment costs.

The invention also provides a machine which transports a set of related documents and orientations to various automation stages to increase uses and lower fulfillment costs.

Another of the invention's objective is to provide a machine which encloses a set of related documents in an opaque or translucent, adhesive or self-adhesive pouch, envelope or attachment method and separate the contained documents for immediate or later use to lower fulfillment costs. The invention also provides a machine which may deliver or affix a set of related documents or control items to a box, package, envelope or device to increase uses and lower fulfillment costs. Another objective of the invention is to provide a machine and process which reliably combine all or parts of stages, and moves related documents from printer, accumulator, folding, enclosing, separation and application stations to another station to lower fulfillment costs.

Other objectives and advantages of this invention will become apparent from the following descriptions, taken in connection with the accompanying drawings. By way of illustration and example, an embodiment of the present invention is further disclosed.

A machine and process comprising of: an adjustable high-speed document receiving station which accepts various sized outputs from common printers. The next device is an adjustable accumulator station using various optical marks and/or software to control the number of documents accumulated forming a set and the movement to further stations. The adjustable document folder station provides various industry standard folds to sets of documents followed by an optional further fold to create a smaller size. An adjustable transport device presents sets of documents to other stations in several orientations, directions and different rotations. Another adjustable device manages single or multiple rolls of adhesive or non-adhesive materials and creates a container, pouch or document attachment. The adjustable cutting or slicing device separates programmed length pouches created from rolls of tape or other material. A further adjustable device dispenses documents, control matter or pouches containing documents into a box, envelope or container. An additional adjustable device applies self-adhesive output directly to a box, envelope, container or item. An adjustable programmed system controls various print, accumulator, folding, enclosing, separation, delivery and application stations for related document preparation and attachment.

The drawings constitute a part of this specification and include embodiments to the invention which may be embodied in various forms. It is to be understood that in some instances various aspects of the invention may be shown exaggerated or enlarged to facilitate an understanding of the invention.

BRIEF DESCRIPTION OF THE DRAWINGS

FIG. 1 is a Perspective View of the invention.

FIG. 2 is a Block Diagram of the invention.

FIG. 3 is an exploded view of the Dual Fold and Orientation system.

FIG. 4 is an exploded view of the Container Creation Device and process.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

The Perspective View, FIG. 1, to the right shows a known generic print station with computer, laser printer and stand to provide the invention with related documents. To the left is the new invention.

The Block Diagram, FIG. 2, provides a more detailed view of the stations and overall new process. The common printer station and certain simple discrete devices are known elements for single tasks such as folding and tape dispensing.

The Dual Fold and Orient concept drawing, FIG. 3, provides a more detailed view of the unique dual fold unit with document handlers to orient material for specific needs. Uses may include, but are not limited to security issues or the ability to display selected areas of a document and manage previously written software. This concept and machine virtually eliminates the need to re-write established software containing determined print locations and reduces fulfillment automation costs.

The Enclosure and Application concept drawing, FIG. 4, provides more detailed views of the new enclosure, application and separation process using one or two rolls of adhesive tape or material. Uses may include, but are not limited to the direct attachment of documents or transponders to items or the manufacture of conventional fulfillment packing slips.

The invention is an adjustable, programmable high-speed machine with central control of the machine and process which, in various ways accepts, accumulates (single or multiple) documents into sets, folds, orients, encloses, separates, delivers and/or applies related documents to goods, boxes, envelopes or other items. The output created by the new machine provides a partially or fully automated process for the creation and application of related documents for uses such as order fulfillment, distribution of goods and/or inventory control.

Referring to the device of FIG. 1, working from right to left, immediately attached to the computer printer system, first is the accumulator station of the invention with central controls and programmable controller and stand, followed by the folding area which controls the size, orientation and presentation of the documents to the following stations. Next is the vertical section directly above the folding station to complete the document travel and orientation. Next to the left is the housing for single and/or double tape rolls, pouch creation, separation and attachment modules.

Referring to FIG. 2, this drawing describes the complete process with all modules and is controlled by software, programmable logic controllers and various sensors with an additional ability to control, or be controlled by external programmable logic controllers or computers for a variety of uses such as, but not limited to assembly line or conveyor system interfacing, or controlling the invention using the document preparation computer or related computer system.

Referring to FIGS. 3 and 4, these drawings describe the document travel, handling, possible manipulation and various pouch creation processes with the attachment process of the invention's output. The concept diagrams begin to show the flexible nature of the invention to accommodate many different uses and commercial applications.

The new sections of the machine and process are a software controlled system combining the specific stations required for the creation or application of related documents or inventory control devices for such uses as inventory control, packing or shipping documents, distribution or shipment of goods. Through the unique use of single or dual rolls of tape the invention creates confidential and useful pouches to enclose related documents or control objects. These pouches are automatically or subsequently attached to goods or items and are generally used to define and display the destination address, courier tracing information, inventory controls or transponders while remaining folded, contained and protected from elements. These documents are used later at the destination to describe the shipment content, descriptive material, operational material, inventory control or other information as required. Through the use of preprinted or non-preprinted tape, translucent and adhesive properties and locations, material type, sensors or transponders applied, varied width, programmed length or overlapping self-adhesive material or backing, the application process, method or usage can be determined by the invention, actual needs and amount of automation desired. Useful pouches may be applied automatically or manually either before or after separation, to meet actual needs or commercial use. The new use of rolled materials combined with various fold types, orientation devices and central control of various other document handling devices and external interfaces virtually eliminates the tedious and manual chore of printing, creating and applying pouches to items, thereby increasing productivity and greatly reducing the cost of this application.

The operation of the device is controlled completely by software, adjustments, sensors and switch options for the specific needs of various commercial applications. It may be programmed and used as a self-contained full or partial automation unit requiring the manual or automatic insertion of single or multiple documents to create various sizes of adhesive or non-adhesive pouches for the manual or automatic attachment to items. Through the use of various stations, adjustments, number of pages, cutting devices, settings, sensors, programs, attachments, interfaces or by-pass modules, the invention partially or fully automates the creation and attachment of many different confidential or non-confidential documents, sensors or inventory transponders to items for various uses such as, but not limited to, order fulfillment, distribution, inventory control or identification.

This invention is most commonly used for but not limited to, the printing of single or multiple pages used as a packing slip document describing the content, courier, optical tracing information, transponder, reference number or other pertinent information and generally folded to one sixth the size of an original letter sized document. In order to not immediately disclose the content of the shipment, these documents are enclosed in a translucent pouch and attached to an item. Only non-confidential and useful information is displayed until the goods are received at the destination. The documents or pouch may also contain other useful information or devices assisting inventory control or distribution of goods and further automate the process thereby lowering associated costs.

Through the invention's material handling devices the document or related material may be held and directly applied to an item. In this case, through the use of specific sizes, devices or material types and adhesion properties, a single roll of tape is used to further reduce costs. Through the use of double rolls of material of varied types, sizes and properties, the invention produces a more common pouch for use in the distribution of goods because it is translucent on one side and adhesive on the other. With an adhesive backing and the invention's material handling devices, the pouch is ready for automatic or manual application to items, before or after pouch separation. This further increases the invention's uses, productive capacity and lowers the cost of operation.

While the invention has been described in connection with a preferred embodiment, it is not intended to limit the scope of the invention to the particular form set forth. On the contrary, it is intended to cover such alternatives, modifications, and equivalents as may be included within the spirit and scope of the invention as defined by the appended claims.

What is claimed is:

1. This is an adjustable high-speed machine that makes and applies related documents to items and is comprised of:

a) a document receiving station which accepts various sized output from printers b) an accumulator station which uses various types of sensors, optical marks and/or software to control the number of documents accumulated to form a set and initiates movement to other stations c) a document folder which provides various industry standard folds to sets of documents, followed by an optional fold to create a smaller size d) a transport device which presents sets of documents to other devices in different orientations and directions e) a device to manage single or multiple rolls of adhesive or non-adhesive materials and create a container or pouch for documents or devices f) a device to cut, slice or separate material at programmed lengths to complete the pouch or container creation process from rolls of tape or other material g) a device to dispense documents or pouches containing documents or items into a box, envelope or container h) a device to apply self-adhesive output directly to a box, envelope, container or item i) a device and software to control various internal and external interfaces and other stations including printers, accumulators, folders, enclosers, separators, delivery, application devices, conveyors or computers.

2. A process that makes and applies related documents to items, comprising the steps and stations of:

a) document receiving which accepts various sized output from printers b) accumulation which uses various types of sensors, optical marks and/or software to control the number of documents accumulated to form a set and initiates movement to other stations c) document folding which provides various industry standard folds to sets of documents followed by an optional fold to create a smaller size d) transport process which presents sets of documents to other devices in different orientations and directions e) management of single or multiple rolls of adhesive or non-adhesive materials and create a container or pouch for documents or devices f) cutting, slicing or separation process for material at programmed lengths to complete the pouch or container creation process from rolls of tape or other material g) dispensing documents or pouches containing documents or items into a box, envelope or container h) application of self-adhesive output directly to a box, envelope, container or item i) controlling and software to manage various internal and external interfaces and other stations including printers, accumulators, folders, enclosers, separators, delivery, application devices, conveyors or computers for the creation and application of related documents to items.

* * * * *